US009121230B2

(12) United States Patent
Saint-Marcoux et al.

(10) Patent No.: US 9,121,230 B2
(45) Date of Patent: Sep. 1, 2015

(54) RESTRAINT SYSTEMS FOR HYBRID DECOUPLED RISERS

(75) Inventors: Jean-Francois Saint-Marcoux, Paris (FR); Allen Leatt, London (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 14/004,350

(22) PCT Filed: Dec. 21, 2011

(86) PCT No.: PCT/GB2011/052551
§ 371 (c)(1),
(2), (4) Date: Nov. 19, 2013

(87) PCT Pub. No.: WO2012/120251
PCT Pub. Date: Sep. 13, 2012

(65) Prior Publication Data

US 2014/0073207 A1 Mar. 13, 2014

(30) Foreign Application Priority Data

Mar. 10, 2011 (GB) ..... 1104101.9

(51) Int. Cl.
*E21B 17/02* (2006.01)
*B63B 22/02* (2006.01)
*E21B 17/01* (2006.01)

(52) U.S. Cl.
CPC ..... *E21B 17/012* (2013.01); *B63B 22/021* (2013.01); *E21B 17/015* (2013.01)

(58) Field of Classification Search
CPC .... E21B 17/012; E21B 17/015; B63B 22/021
USPC ..... 405/224.2, 224.3, 224.4; 441/3, 4, 5; 166/350, 367
See application file for complete search history.

(56) References Cited

U.S. PATENT DOCUMENTS

| | | | | |
|---|---|---|---|---|
| 6,321,844 | B1 * | 11/2001 | Thiebaud et al. | 166/345 |
| 6,595,725 | B1 * | 7/2003 | Shotbolt | 405/224.2 |
| 7,434,624 | B2 | 10/2008 | Wilson | |
| 7,946,790 | B2 | 5/2011 | Casola et al. | |
| 8,123,437 | B2 | 2/2012 | Wolbers et al. | |

(Continued)

FOREIGN PATENT DOCUMENTS

| | | |
|---|---|---|
| GB | 2 346 188 | 8/2000 |
| GB | 2 429 993 | 3/2007 |
| WO | WO 97/22780 | 6/1997 |
| WO | WO 00/08262 | 2/2000 |
| WO | WO 2008/152505 | 12/2008 |

OTHER PUBLICATIONS

"Low Sulfate Water Injection Knocks Scaling Off Production Hit-List", Jeremy Beckman, Offshore, Apr. 1998, vol. 58, Issue 4.*

*Primary Examiner* — Benjamin Fiorello
*Assistant Examiner* — Stacy Warren
(74) *Attorney, Agent, or Firm* — Levy & Grandinetti

(57) ABSTRACT

A seabed-to-surface riser system is disclosed. The seabed-to-surface riser system has a group of subsea riser supports that each support riser pipes extending from the seabed to mid-water. Jumper pipes extend from there to a floating production, storage and offloading (FPSO) offset horizontally from the riser support in a flow direction. The group of riser supports is disposed to one side of the surface installation. Laterally-extending lines are attached to at least the outermost riser supports of the group. Those lines apply mutually-opposed stabilizing forces to those outermost riser supports in directions transverse to the flow direction.

23 Claims, 4 Drawing Sheets

(56) References Cited

U.S. PATENT DOCUMENTS

| | | | | |
|---|---|---|---|---|
| 2004/0129425 | A1 | 7/2004 | Wilson | |
| 2006/0056918 | A1 | 3/2006 | Luppi | |
| 2008/0253842 | A1 | 10/2008 | Wolbers et al. | |
| 2008/0311804 | A1* | 12/2008 | Bauduin et al. | 441/23 |
| 2012/0292040 | A1* | 11/2012 | Prescott | 166/345 |

* cited by examiner

RESTRAINT SYSTEMS FOR HYBRID DECOUPLED RISERS

This Application is the U.S. National Phase of International Application Number PCT/GB2011/052551 filed on Dec. 21, 2011, which claims priority to Great Britain Application No. 1104101.9 filed on Mar. 10, 2011.

BACKGROUND OF THE INVENTION (1) Field of Invention

This invention relates to subsea risers used to transport well fluids from the seabed to a surface installation such as an FPSO vessel or a platform. The invention relates particularly to systems for restraining movement of such risers under the action of currents or excursion of an FPSO.

Hybrid riser systems have been known for many years. Such systems use riser pipes, possibly of lined and coated steel, that extend upwardly from the seabed to near the surface. Flexible jumper pipes extend from there to the surface to add compliancy that decouples the more rigid riser pipes from surface movement induced by waves and tides. The riser pipes experience less stress and fatigue as a result, especially at the vulnerable sag bend near their touchdown point on the seabed.

More specifically, a hybrid riser system comprises a subsea riser support extending from a seabed anchorage to an upper end held buoyantly in mid water, at a depth below the influence of likely wave action. A depth of 250 m is typical for this purpose but this may vary according to the sea conditions expected at a particular location.

The riser support may comprise a hybrid riser tower or 'HRT' pivotably attached to the anchorage and held in tension by buoyancy at its upper end, or a riser support buoy tethered to the anchorage under tension. A riser support buoy is sometimes referred to by the acronym 'BSR', derived from the Portuguese term 'bóia de suporte de riser'. That acronym will be used to identify riser support buoys in the description that follows.

Riser pipes extend from the seabed to the upper end region of the riser support. In the case of an HRT, the riser pipes will typically extend along the HRT as an upright bundle of generally parallel pipes. In the case of a BSR, the riser pipes will typically hang freely from, and splay away from, the BSR as steel catenary risers or 'SCRs'. SCRs are a non-limiting example: other types of pipe are possible for the riser pipes.

Jumper pipes hanging as catenaries extend from the upper end region of the riser support to an FPSO or other surface installation. The FPSO is moored at a location above the riser support and spaced or offset horizontally from the riser support.

When viewed from above so that the arcuate shape of the jumper pipes and the depth of the riser support beneath the surface is not apparent, there is a general flow direction extending from the upper end region of the riser support toward the FPSO. The flow direction will be used to explain the present invention in more detail and is illustrated in FIGS. 2*a*, 3*a* and 4*a* of the accompanying drawings.

In the case of a BSR, when similarly viewed from above, the SCRs extend from the BSR in a direction generally opposed to the flow direction; optionally, the SCRs also diverge from each other moving away from the BSR.

Umbilicals and other pipes generally follow the paths of the riser pipes and jumper pipes to carry power, control data and other fluids.

In deep water, a surface installation such as an FPSO will usually have spread moorings. Spread moorings typically comprise four sets of mooring lines (each set being of say four to six mooring lines) with the sets radiating with angular spacing from the FPSO to anchors such as suction piles or torpedo piles embedded in the seabed. Such moorings can maintain the FPSO on location for several years at a fixed orientation or heading without 'weathervaning' rotation about a vertical axis. This minimal yaw movement means that there is no need for a turret structure or for swivel connections for fluids, power and control data. The connections are therefore advantageously simplified. Also, flexible riser pipes and umbilicals may simply be connected amidships along sides of the FPSO, which maximises the space available for those connections.

In a spread-moored arrangement, a riser system is typically accommodated between neighbouring sets of mooring lines of the FPSO. Space may be limited such that in extreme weather conditions, there is a potential for interference between the mooring lines of the FPSO and the riser supports and/or the riser pipes.

The potential for interference is greater still where a plurality of riser supports are combined with a single surface installation such as an FPSO, as more space is required for plural riser supports. Also, arrangements having a plurality of riser supports introduce the further risk of interference between neighbouring riser supports or between the riser pipes carried by those neighbouring riser supports.

It is desirable to stabilise riser supports against excessive movement in extreme conditions. The buoyancy that creates tension in a riser support is a stabilising factor; so too is the horizontal component of the force applied to the riser support by the jumper pipes. Also, where SCRs or other riser pipes hang from a BSR, the SCRs apply to a lesser extent a force to the BSR whose horizontal component is opposed to the horizontal component of the force applied to the BSR by the jumper pipes. This, too, helps to stabilise a BSR. However it may be desirable to apply other stabilising restoring forces to a riser support.

(2) Description of Related Art

GB 2346188, U.S. Pat. No. 6,595,725 and US 2006/0056918 disclose riser arrangements in which a plurality of riser supports are shared by a single surface installation. GB 2346188 discloses a row of HRTs whereas U.S. Pat. No. 6,595,725 and US 2006/0056918 each disclose two BSRs. All of those documents propose additional means for stabilising the riser supports but they work in very different ways—none of which are helpful for the purposes of the present invention.

GB 2346188 discloses interconnecting tethers between the riser towers near their upper ends. This interconnection is intended to limit differential movement between the neighbouring riser towers but it also allows—and indeed encourages—the whole row of riser towers to move together. So, there is nothing to prevent the row of towers colliding with any adjacent spread moorings. Also, the interconnecting tethers in GB 2346188 hang as shallow catenaries and so have negative buoyancy, which means that the riser towers will be pulled together by the tension in the tethers due to their weight. In practice, this will cause the riser towers to lean toward each other, thus increasing the risk of collision between neighbouring towers in extreme conditions. This is a particular risk with the towers at the ends of the row.

U.S. Pat. No. 6,595,725 discloses two riser supports but they are not grouped together: instead, one riser support is disposed to each side of a production facility floating above. The jumper pipes and riser pipes apply opposed stabilising forces to each riser support in directions parallel to the flow direction. Additionally, guy lines extend to the seabed from each riser support to prevent lateral movement due to water current. There is no practical risk of collision between the riser supports and there is space to avoid collision between the riser supports and spread moorings of the production facility. However, the arrangement would not be suitable for accommodating a group of two or more aligned riser supports between neighbouring sets of mooring lines of a spread-moored FPSO.

US 2006/0056918 discloses a weighted line between two riser supports but the weighted line only applies restoring forces parallel to the flow direction. As in U.S. Pat. No. 6,595,725 above, the riser supports are not grouped to one side of a surface installation floating above: instead, one riser support is disposed to each side of the surface installation. Again, therefore, there is no risk of collision between the riser supports and there would be space to avoid collision between the riser supports and spread moorings, if used.

If the riser supports of U.S. Pat. No. 6,595,725 or US 2006/0056918 were grouped to one side of the surface installation (not that there is any motivation or suggestion in those documents to adapt those proposals in that way), there would be a risk of collision between the riser supports and between the riser supports and spread moorings, if used.

It is against this background that the present invention has been devised.

BRIEF SUMMARY OF THE INVENTION

The invention resides in a seabed-to-surface riser system of the type comprising: a group of two or more subsea riser supports each extending upwardly from a seabed anchorage to a buoyant upper end region located beneath the surface and each supporting at least one riser pipe extending from the seabed to the upper end region; and at least one jumper pipe extending from the upper end region of each riser support to a surface installation at a location above the riser support and spaced horizontally from the riser support in a flow direction.

Expressed broadly, the invention contemplates that the group of riser supports is disposed to one side of the surface installation; that at least outermost riser supports of the group lie on an axis transverse to the flow direction; that a plurality of laterally-extending flexible lines are attached to each of those outermost riser supports, those lines applying mutually-opposed stabilising forces to each outermost riser support in directions transverse to the flow direction; and that at least one of the laterally-extending flexible lines is a mooring line that extends from an outermost riser support of the group to the seabed.

By virtue of the invention, movement of the group of riser supports is effectively restrained. This enables better use of space without risking interference with other subsea elements such as FPSO moorings.

Each riser support extends substantially vertically from its seabed anchorage with an angle from vertical from 0 to 15 deg and preferably from 0 to 10 degree. This deviation from vertical is due to horizontal current and forces applied on the riser support by FPSO.

In some embodiments, a riser support of the group is preferably connected to one or more neighbouring riser supports of the group by at least one line extending transversely with respect to the flow direction. This helps to control movement of riser supports with respect to each other, and enhances control of movement in the system as a whole.

To restrain the riser supports in orthogonal directions, at least two lines may splay laterally from at least one side of a riser support of the group. For example, at least two lines may splay laterally from one side of a riser support of the group and at least one line may extend laterally from an opposite side of that riser support to apply opposed stabilising forces to that riser support.

In an embodiment of the invention to be described, at least one riser support of the group is coupled by a line to the surface installation. Preferably that line extends laterally from the riser support to impart a stabilising force to the riser support transverse to the flow direction. The riser support may, for example, be braced between a mooring line and a line coupling the riser support to the surface installation, those lines applying stabilising forces to the riser support in opposite and substantially aligned directions.

More preferably, at least two riser supports of the group are coupled by respective lines to the surface installation, which lines initially converge as they extend from the riser supports to the surface installation. In a compact variant of this arrangement, the lines that couple the riser supports to the surface installation cross over between the riser supports and the surface installation and then diverge from a cross-over point to attachment points on the surface installation spaced in a direction transverse to the flow direction. In that case, one of those lines is suitably supported by a subsea buoy around the cross-over point to raise it above the other such line that it crosses.

The invention has particular advantages where the surface installation has spread moorings, as the invention enables a group of riser supports to be disposed between neighbouring sets of mooring lines of the spread moorings. At least one of the laterally-extending lines that is a mooring line is preferably supported by a subsea buoy to raise that mooring line above spread mooring elements of the surface installation. This avoids possible interference between the riser system and the spread moorings.

The riser supports may comprise HRTs or BSRs but the invention also has particular advantages when applied to BSRs. Here, a riser support comprises a subsea buoy tethered to a foundation, and the riser pipes preferably extend downwardly from the buoy and in a direction opposed to the flow direction. It is then possible for the buoy to be subject to stabilising forces in the flow direction from the jumper pipes, opposite to the flow direction from the riser pipes, and transverse to the flow direction from opposed laterally-extending lines.

Two or more laterally-extending lines may be attached to a subsea buoy at mutually-spaced locations on the buoy to resist yaw movement of the buoy. Those lines preferably extend from one side of the buoy.

Riser supports of the group are preferably substantially aligned on an axis transverse to or orthogonal to the flow direction. Where the surface installation is an FPSO, that axis is suitably substantially parallel to a central longitudinal axis of the FPSO. The laterally-extending lines may be disposed substantially in a plane containing that axis.

In the embodiments of the invention to be described, the group of riser supports comprises at least two outer riser supports moored to the seabed or to the surface installation by laterally-extending lines and at least one inner riser support between the outer riser supports. The inner riser support may be coupled to at least one of the outer riser supports.

BRIEF DESCRIPTION OF THE DRAWINGS

In order that the invention may be more readily understood, reference will now be made by way of example to the accompanying drawings, in which.

DETAILED DESCRIPTION OF THE INVENTION

Figure 1:
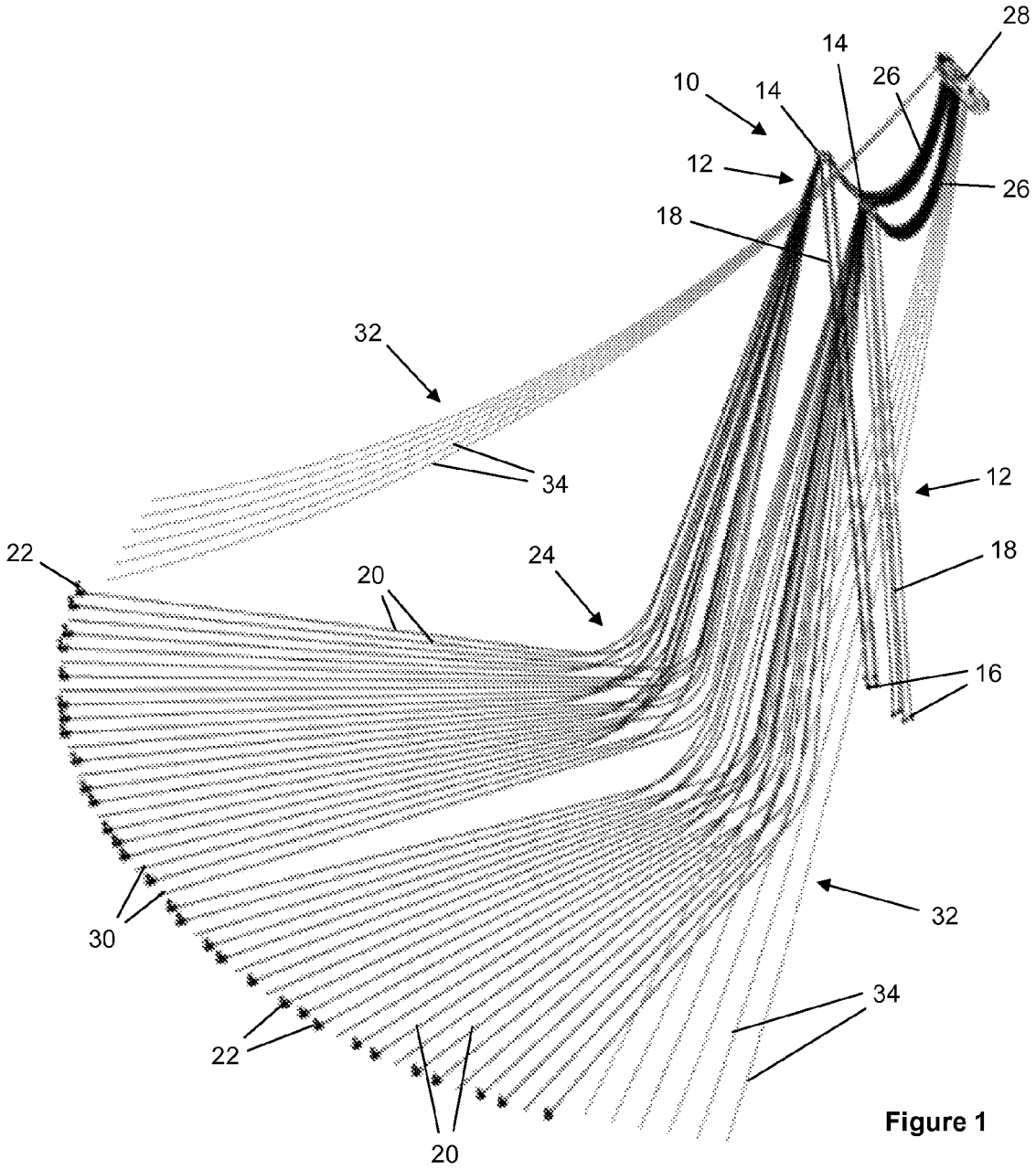
FIG. 1 is a perspective view of a riser installation to which restraint systems of the invention may be applied, the installation comprising two BSRs used with a single spread-moored FPSO.

FIG. 1 of the drawings does not show the restraint systems of the invention but instead explains their context. In contrast, the remaining Figures are schematic and show embodiments of the invention. Like numerals are used for like parts where appropriate.

Referring firstly then to FIG. 1 to appreciate the background of the invention, a riser installation 10 comprises two riser supports 12 each comprising a BSR 14, a seabed foundation 16 and a tether arrangement 18 extending between the foundation 16 and the BSR 14. Each tether arrangement 18 comprises four tethers in this example, maintained under tension by the buoyancy of the BSR 14.

Each BSR 14 supports a group of riser pipes 20 in the form of SCRs that each extend from respective PLETs 22 across the seabed, through a sag bend 24 and from there up to the BSR 14. The riser pipes 20 splay apart moving downwardly and away from the BSR and each group of riser pipes 20 fans out across the seabed to the PLETs 22.

Each riser pipe 20 communicates with a respective jumper pipe 26 that hangs as a catenary between the BSR 14 and an FPSO 28. The FPSO 28 is moored with its hull extending parallel to an axis containing both BSRs 14, whereby the jumper pipes 26 connect amidships to one side of the FPSO 28.

As noted previously, umbilicals and other pipes 30 generally follow the paths of the riser pipes 20 and jumper pipes 26. These pipes 30 can be distinguished from the riser pipes 20 in FIG. 1 as they do not terminate in PLETs 22, and as they have a smaller bend radius at the sag bend 24. Umbilicals and other pipes 30 are omitted from the remaining Figures for clarity.

The FPSO 28 shown in FIG. 1 is spread-moored with four sets 32 of six mooring lines 34. Two of those sets 32 of mooring lines 34—one attached near each end of the FPSO 28—are shown in FIG. 1 and indeed in all of the Figures except FIG. 2*a*, which shows all four sets 32 around the FPSO 28.

It will be clear from FIG. 1 that the riser installation 10 is accommodated closely between these neighbouring sets 32 of mooring lines 34. It is desirable to space the riser pipes 20 and other pipes 30 as far apart as possible and so to maximise usage of the space between the neighbouring sets 32 of mooring lines 34. Thus, the outermost PLETs 22 are close to the seabed anchors of the innermost mooring lines 34.

The restraint systems of the invention allow the riser pipes 20, PLETs 22 and so on to be arranged to best effect, with maximum possible spacing within the confines of the spread moorings without risking interference between the mooring lines 34 and the riser supports 12 or the riser pipes 20.

Figure 2A:
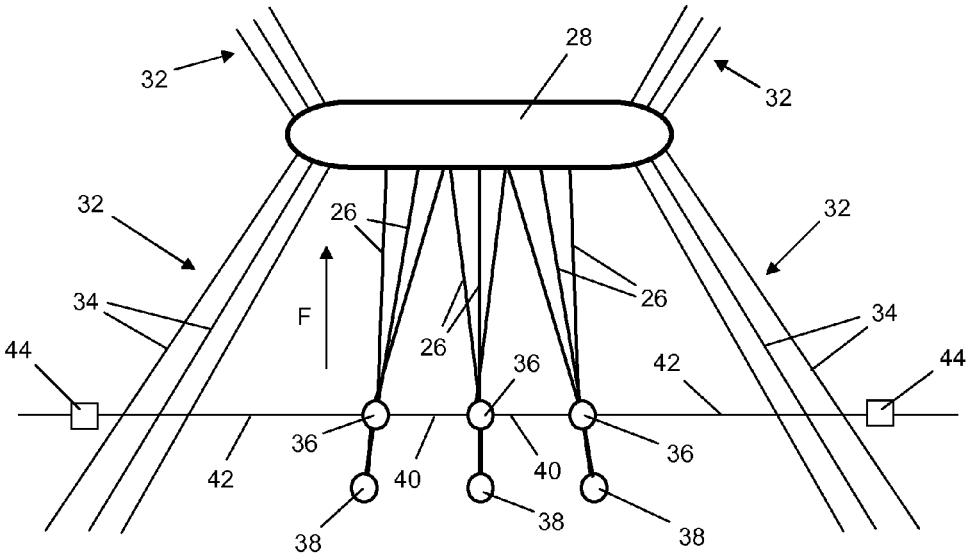
FIG. 2*a* is a schematic plan view of a riser installation comprising three HRTs and having a restraint system in accordance with the invention.
Figure 2B:
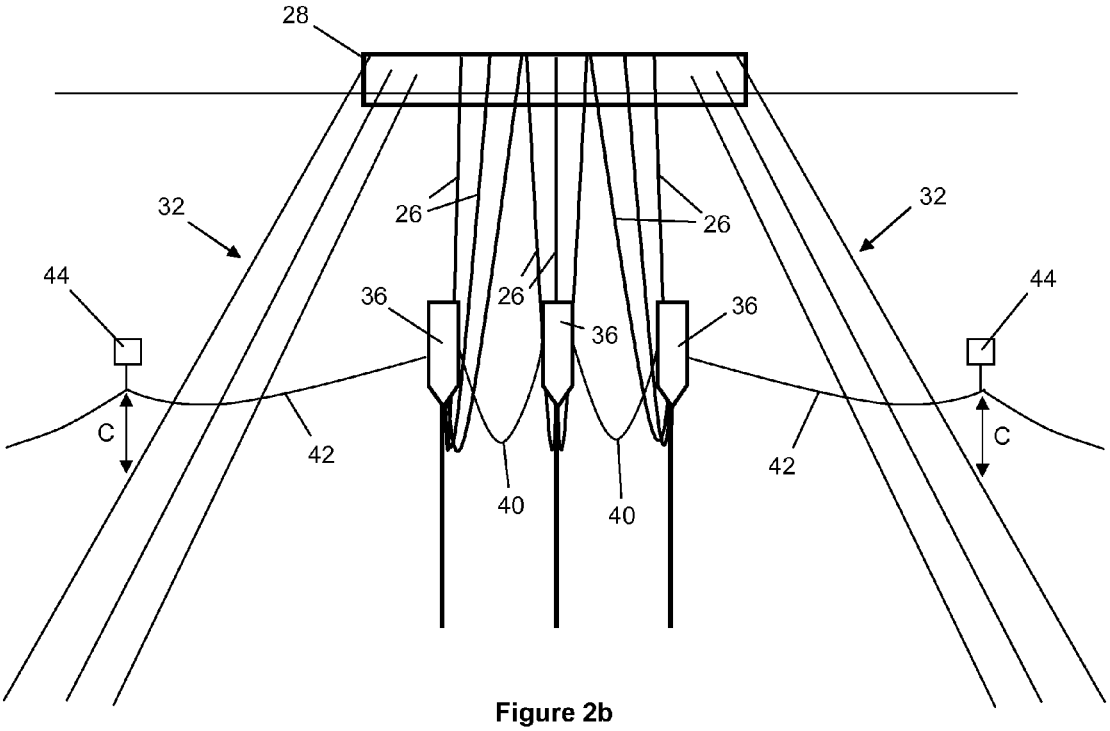
FIG. 2*b* is a schematic side view of the riser installation of FIG. 2*a;*

Moving on now to FIGS. 2*a* and 2*b*, these show a first embodiment of the invention applied to a group of three HRTs 36 extending upwardly in a row from respective seabed anchorages or foundations 38 to a mid-water position. The HRTs 36 are spaced apart along a common axis that lies generally parallel to the longitudinal centreline of the FPSO 28.

For ease of illustration, each HRT 36 is shown with just three riser pipes and jumper pipes 26 extending as a catenary to the FPSO 28. The jumper pipes 26 of each HRT 36 may splay apart slightly, as shown, from the HRT 36 to the FPSO 28 but the jumper pipes 26 of the HRTs 36 in general may converge slightly from the HRTs 36 to the FPSO 28 as shown.

Arrow F in FIG. 2*a* shows the aforementioned general flow direction extending from the HRTs 36 toward the FPSO 28. This may be helpful for understanding and defining the invention. In this example, the general flow direction is orthogonal to the axis of the HRTs 36 and it will usually be at least transverse to, or intersect, the axis of the HRTs 36.

In this embodiment of the invention, neighbouring HRTs 36 are optionally coupled together by laterally-extending lines 40 that hang as catenaries in a plane containing the axis of the HRTs 36. The innermost, central HRT 36 is coupled to two such lines 40, one to each side, extending from the central HRT 36 to respective ones of the outermost HRTs 36.

In turn, further laterally-extending lines 42 extend outwardly and generally downwardly from the outermost HRTs 36. The lines 42 are moored to the seabed in this embodiment. Again, the lines 42 hang in a plane containing the axis of the HRTs 36. The lines 40, 42 thus apply mutually-opposed stabilising or restoring forces to the HRTs 36, in directions transverse to (in this case orthogonal to) the flow direction shown by arrow F.

Optionally as shown, each line 42 is supported at an intermediate location by a subsea buoy 44. The buoy 44 reduces stress in the line 42 and also, elegantly, ensures ample clearance where the line 42 crosses over an adjacent set 32 of mooring lines 34 attached to the FPSO 28. Arrows C in FIG. 2*b* show this clearance schematically.

Figure 3A:
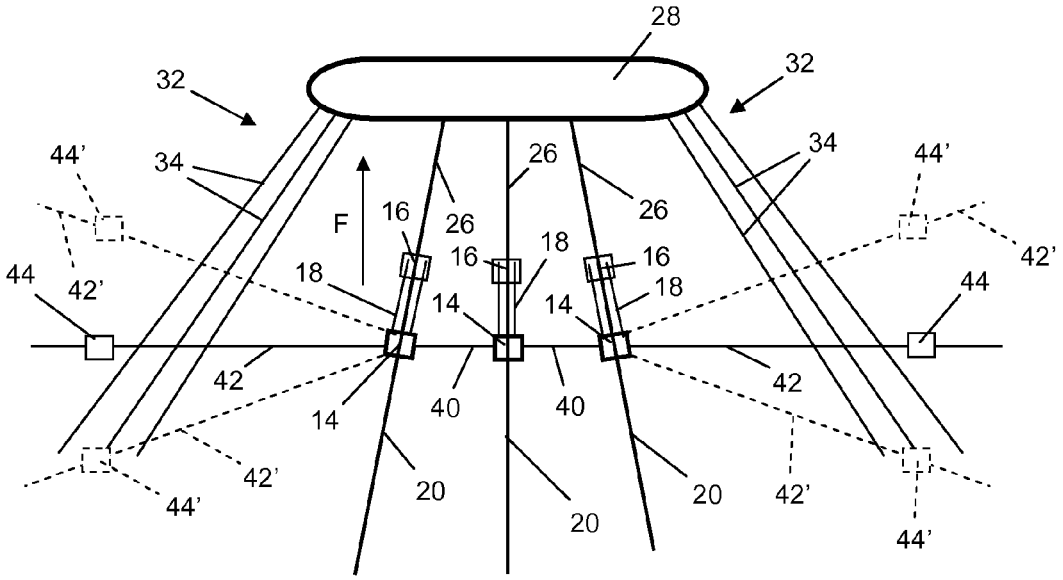
FIG. 3*a* is a schematic plan view of a riser installation comprising three BSRs and having an alternative restraint system in accordance with the invention.
Figure 3B:
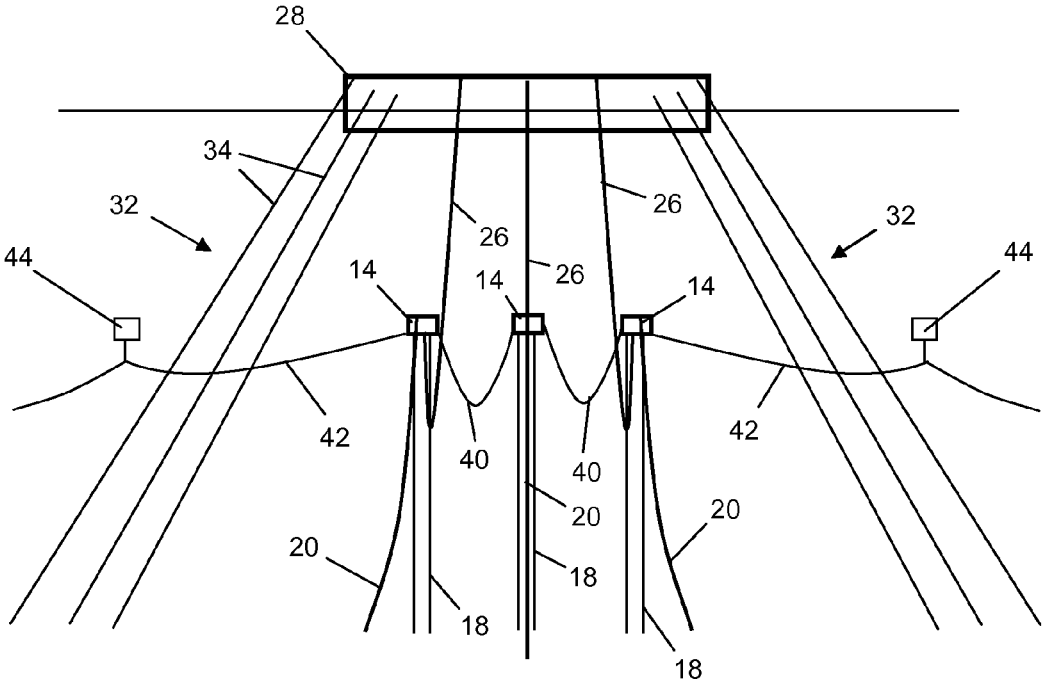
FIG. 3*b* is a schematic side view of the riser installation of FIG. 3*a;*

The second embodiment of the invention in FIGS. 3*a* and 3*b* shows how the restraint system of the invention may also be applied to a group of BSRs 14, in this case three BSRs 14 in a row. The BSRs 14 are spaced apart along a common axis that lies generally parallel to the longitudinal centreline of the FPSO 28. They are suspended in a mid-water position by tether arrangements 18 attached to respective seabed foundations 16 in the manner shown in FIG. 1.

For ease of illustration, each BSR 14 is shown with just one riser pipe 20 extending from the seabed to the BSR 14 and just one jumper pipe 26 extending from the BSR 14 to the FPSO 28. In practical applications, there will generally be several such pipes as FIG. 1 makes clear.

Other features of this second embodiment are similar to those of the first embodiment shown in FIGS. 2*a* and 2*b*. Arrow F in FIG. 3*a* shows the aforementioned general flow direction that, in this case, extends from the BSRs 14 toward the FPSO 28. Again, the general flow direction is orthogonal to the axis of the BSRs 14 in this example and it will usually be at least transverse to, or intersect, the axis of the BSRs 14.

Again, optionally, neighbouring BSRs 14 are coupled together by laterally-extending lines 40 that hang as catenaries in a plane containing the axis of the BSRs 14. The innermost, central BSR 14 is therefore coupled to two such lines 40, one to each side, extending from the central BSR 14 to respective ones of the outermost BSRs 14.

Again, further laterally-extending lines 42 extend outwardly and generally downwardly from the outermost BSRs 14 in a plane containing the axis of the BSRs 14, to be moored to the seabed. And again, each line 42 is supported at an intermediate location by a subsea buoy 44 that ensures clearance where the line 42 crosses over an adjacent set 32 of mooring lines 34 attached to the FPSO 28.

In a similar manner to the first embodiment, the lines 40, 42 thus apply mutually-opposed stabilising or restoring forces to the BSRs 14, in directions transverse to (in this case orthogonal to) the flow direction shown by arrow F.

FIG. 3*a* shows, in dashed lines, a variant of this second embodiment in which the lines 42' extending outwardly from the outermost BSRs 36 depart from the plane containing the axis of the BSRs 14. Indeed, there may be two such lines 42' on each of the outermost BSRs 14, diverging from the plane containing the axis of the BSRs 14. This provides opposed restoring forces acting parallel to the flow direction of arrow F, to restrain the BSRs 14 against inward or outward movement with respect to the FPSO 28. Also, if the lines 42' are attached to different points on the BSRs 14 such as different corners as shown, they will resist yaw of the BSRs 14. Again, subsea buoys 44' ensure clearance where the lines 42' cross over adjacent sets 32 of mooring lines 34 attached to the FPSO 28.

Figure 4A:
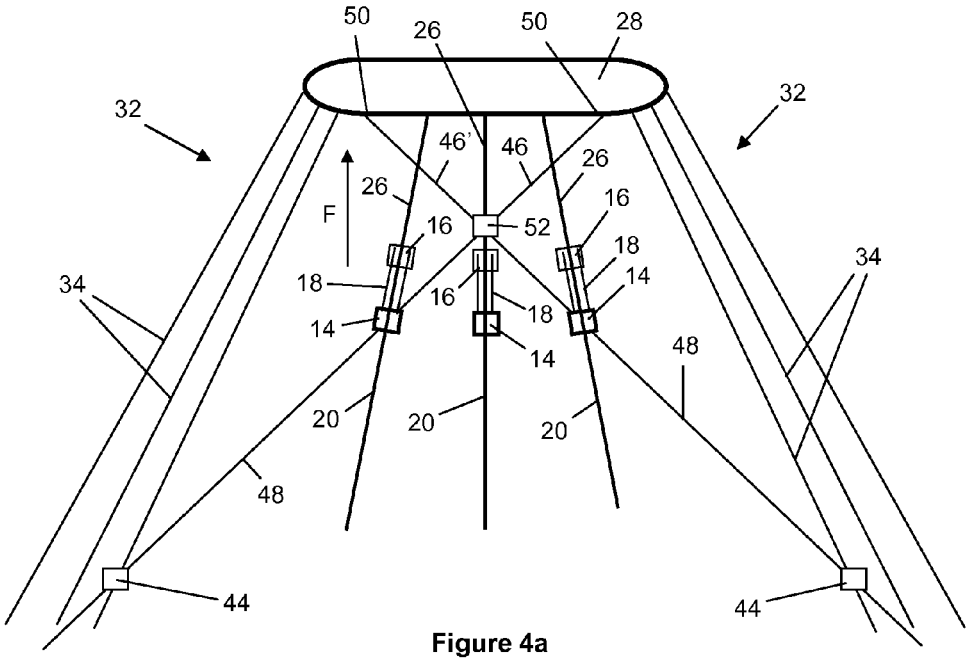
FIG. 4*a* is a schematic plan view of a riser installation comprising three BSRs and having a further alternative restraint system in accordance with the invention.
Figure 4B:
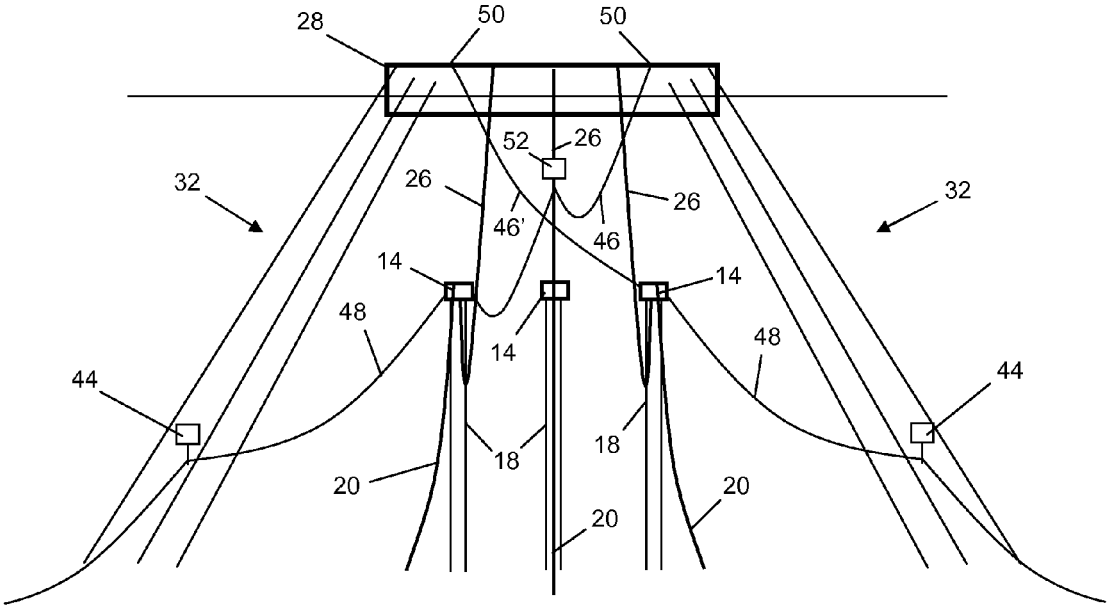
FIG. 4*b* is a schematic side view of the riser installation of FIG. 4*a.*

Referring finally to the third embodiment shown in FIGS. 4*a* and 4*b* of the drawings, here again there are three BSRs 14 in a row. Again, the BSRs 14 are spaced apart along a common axis that lies generally parallel to the longitudinal centreline of the FPSO 28. The BSRs 14 are suspended in a mid-water position by tether arrangements 18 attached to respective seabed foundations in the manner shown in FIG. 1.

For ease of illustration, each BSR 14 is again shown with just one riser pipe 20 extending from the seabed to the BSR 14 and just one jumper pipe 26 extending from the BSR 14 to the FPSO 28.

Again, arrow F in FIG. 4*a* shows the aforementioned general flow direction extending from the BSRs 14 toward the FPSO 28. That flow direction is orthogonal to the axis of the BSRs 14 in this illustration and it will usually be at least transverse to, or will intersect, the axis of the BSRs 14.

In this third embodiment, the outermost BSRs 14 are braced respectively by laterally-extending lines 46, 46' that are angled to connect to the FPSO 28 and by opposed laterally-extending lines 48 that extend outwardly and generally downwardly to be moored to the seabed. The lines 48 are substantially aligned with the associated lines 46, 46' in plan view as shown in FIG. 4*a*.

To impart a restoring force component in a direction orthogonal to the flow direction of arrow F, the lines 46, 46' extend at angles that lie between the flow direction and the common axis of the BSRs 14, approximately in the range 30° to 60° and preferably in the range 40° to 50° with respect to the flow direction as shown.

The plan view of FIG. 4*a* also shows that, for compactness, the lines 46, 46' cross over to connect to attachment points 50 spaced along the FPSO 28 at ends opposed to the BSRs 14 from which the lines 46, 46' originate. As FIG. 4*b* makes clear, the line 46' is in a shallow catenary form and the line 46 is in a lazy-W form suspended near its mid-point by a subsea buoy 52 to provide clearance for the line 46' extending beneath.

Like the first and second embodiments, the lines 46, 46', 48 thus apply mutually-opposed stabilising or restoring forces to the outermost BSRs 14, with components in directions orthogonal to and also parallel with the flow direction shown by arrow F.

As on the lines 42, 42' of the preceding embodiments, optional subsea buoys 44 ensure clearance where the lines 48 cross over adjacent sets 32 of mooring lines 34 attached to the FPSO 28.

In the third embodiment, neighbouring BSRs 14 are not coupled together by the laterally-extending lines 40 of the preceding embodiments. The innermost, central BSR 14 is therefore restrained only by the restoring forces applied by the riser pipes 20 and jumper pipes 26 and by the buoyancy of that BSR 14. However such lines 40 are optional and may be added to the third embodiment if it is desired to couple the central BSR 14 to each of the outermost BSRs 14.

The lines 42, 42' and 48 in the embodiments described above could, for example, be made of fibre rope to minimise their weight.

The invention claimed is:

1. A seabed-to-surface riser system comprising:

a group of two or more subsea riser supports each extending upwardly from a seabed anchorage to a buoyant upper end region located beneath the surface and each supporting at least one riser pipe extending from the seabed to the upper end region; and at least one jumper pipe extending from the upper end region of each riser support to a surface installation at a location above the riser support, the riser supports and the surface installation defining a flow direction of well fluids that, when the system is viewed from above, extends generally from the upper end regions of the riser supports toward the surface installation, and the surface installation being spaced horizontally from the riser supports in the flow direction;

wherein:

the group of riser supports is disposed to one side of the surface installation;

at least outermost riser supports of the group lie on an axis transverse to the flow direction;

a plurality of laterally-extending flexible lines are attached to each of the outermost riser supports, the plurality of laterally-extending flexible lines each applies mutually-opposed stabilising forces to each of the riser supports in the group of riser supports in directions transverse to the flow direction; and at least one of the laterally-extending flexible lines is a mooring line that extends from an outermost riser support of the group to the seabed, wherein a riser support of the group is connected to one or more neighbouring riser supports of the group by at least one of the laterally-extending flexible lines extending transversely with respect to the flow direction.

2. The riser system of claim 1, wherein at least two of the laterally-extending flexible lines splay laterally from one side of a riser support of the group.

3. The riser system of claim 2, wherein the at least two of the laterally-extending flexible lines splay laterally from one side of a riser support of the group and at least one of the laterally-extending flexible lines extends laterally from an opposite side of that riser support to apply opposed stabilising forces to that riser support.

4. The riser system of claim 1, wherein at least one riser support of the group is coupled by at least one of the laterally-extending flexible lines to the surface installation.

5. The riser system of claim 4, wherein the line coupling the at least one riser support to the surface installation extends laterally from the riser support to impart a stabilising force to the riser support transverse to the flow direction.

6. The riser system of claim 5, wherein the line coupling the at least one riser support to the surface installation is disposed at an angle in the range 30° to 60° with respect to the flow direction.

7. The riser system of claim 6, wherein the line coupling the at least one riser support to the surface installation is disposed at an angle in the range 40° to 50° with respect to the flow direction.

8. The riser system of claim 4, wherein at least two riser supports of the group are coupled by at least two of the laterally-extending flexible lines to the surface installation, which lines initially converge as they extend from the at least two riser supports to the surface installation.

9. The riser system of claim 8, wherein, when viewed from above, the at least two of the laterally-extending flexible lines that couple the at least two riser supports to the surface installation cross over between the at least two riser supports and the surface installation, then diverge from a cross-over point to attachment points on the surface installation spaced in a direction transverse to the flow direction.

10. The riser system of claim 9, wherein one of the at least two of the laterally-extending flexible lines that couple the at least two riser supports to the surface installation is supported by a subsea buoy around the cross-over point to raise it above the other such line that it crosses.

11. The riser system of claim 1, wherein the surface installation has spread moorings and at least one of the laterally-extending flexible lines that is a mooring line is supported by a subsea buoy to raise that mooring line above the spread moorings of the surface installation.

12. The riser system of claim 4, wherein the at least one riser support of the group coupled to the surface installation is braced between the mooring line and the at least one of the laterally-extending flexible lines coupling the at least one riser support of the group coupled to the surface installation, those lines applying stabilising forces to the riser support in opposite and substantially aligned directions.

13. The riser system of claim 1, wherein the surface installation has spread moorings, and the group of riser supports is disposed between neighbouring sets of mooring lines of the spread moorings.

14. The riser system claim 1, wherein one of the riser supports comprises a subsea buoy tethered to a foundation, and the riser pipes extend downwardly from the buoy and in a direction opposed to the flow direction.

15. The riser system of claim 14, wherein the buoy is subject to stabilising forces in the flow direction from the jumper pipes, opposite to the flow direction from the riser pipes, and transverse to the flow direction from opposed laterally-extending lines.

16. The riser system of claim 14, wherein two or more laterally-extending lines are attached to the buoy at mutually-spaced locations on the buoy to resist yaw movement of the buoy.

17. The riser system of claim 16, wherein said two or more laterally-extending lines extend from one side of the buoy.

18. The riser system of claim 1, wherein riser supports of the group are substantially aligned on an axis orthogonal to the flow direction.

19. The riser system of claim 18, wherein the surface installation is an FPSO and said axis orthogonal to the flow direction is substantially parallel to a central longitudinal axis of the FPSO.

20. The riser system of claim 18, wherein the laterally-extending flexible lines are disposed substantially in a plane containing said axis orthogonal to the flow direction.

21. The riser system of claim 1, wherein the group of riser supports comprises at least two outer riser supports moored to the seabed or to the surface installation by laterally-extending lines and at least one inner riser support between the outer riser supports.

22. The riser system of claim 21, wherein the inner riser support is coupled to at least one of the outer riser supports.

23. The riser system of claim 1, wherein the laterally-extending flexible lines are at least partially of fibre rope.

* * * * *